US009786399B2

(12) United States Patent
Delangis

(10) Patent No.: US 9,786,399 B2
(45) Date of Patent: Oct. 10, 2017

(54) SELF-RECHARGING DIRECT CONVERSION ELECTRICAL ENERGY STORAGE DEVICE AND METHOD

(71) Applicant: Eric Delangis, Huntsville, AL (US)

(72) Inventor: Eric Delangis, Huntsville, AL (US)

( * ) Notice: Subject to any disclaimer, the term of this patent is extended or adjusted under 35 U.S.C. 154(b) by 1363 days.

(21) Appl. No.: 13/851,890

(22) Filed: Mar. 27, 2013

(65) Prior Publication Data

US 2013/0302650 A1 Nov. 14, 2013

Related U.S. Application Data

(60) Provisional application No. 61/616,100, filed on Mar. 27, 2012.

(51) Int. Cl.
*G21H 1/02* (2006.01)
*G21H 1/00* (2006.01)

(52) U.S. Cl.
CPC ..... *G21H 1/02* (2013.01); *G21H 1/00* (2013.01)

(58) Field of Classification Search
CPC ..... F01K 3/181; Y02E 60/12
See application file for complete search history.

(56) References Cited

U.S. PATENT DOCUMENTS 4,097,654 A * 6/1978 Guazzoni ..... G21H 1/103 429/120
4,547,439 A * 10/1985 Genies ..... C08G 61/122 429/105
5,280,213 A * 1/1994 Day ..... G21D 7/00 136/253
5,825,839 A * 10/1998 Baskis ..... G21H 1/00 136/202
5,859,484 A * 1/1999 Mannik ..... G21H 1/06 136/202
2005/0082942 A1* 4/2005 Shirley ..... G21H 1/00 310/303
2009/0259420 A1* 10/2009 Greening ..... H01M 4/364 702/63

* cited by examiner

*Primary Examiner* — Alix Eggerding
(74) *Attorney, Agent, or Firm* — Clay McGurk; The Law Office of Clay McGurk

(57) ABSTRACT

A method and apparatus for collecting and storing the energy emitted by radioisotopes in the form of alpha and or beta particles is described. The present invention incorporates aspects of three different energy conversion and storage technologies, those being: Nuclear alpha and or beta particle capture for direct energy conversion and storage, rechargeable electrochemical storage cells and capacitive electrical energy storage.

17 Claims, 6 Drawing Sheets

SELF-RECHARGING DIRECT CONVERSION ELECTRICAL ENERGY STORAGE DEVICE AND METHOD

CROSS-REFERENCE TO RELATED APPLICATIONS

This application is a continuation of U.S. Patent Application Ser. No. 61/616,100 filed Mar. 27, 2012, which is hereby incorporated by reference in its entirety.

BACKGROUND OF THE INVENTION

The idea of using radioactive materials as direct power sources for applications requiring long-lived power sources has been investigated for many decades. Nuclear power sources for deep space probes have been used on many NASA programs especially those that last for decades and where the probes will not have sufficient sunlight for solar panels to operate. Nuclear Batteries, also called atomic batteries, have been developed that attempt to exploit the heat or thermal energy of the radioactive materials as well as the alpha and beta particle emissions energy through various means. Typically these devices tend to be large in comparison to typical electrochemical batteries and also tend to suffer from the emissions of high energy particles including alpha, beta, gamma and neutrons which create human health risks. Besides space probes, small nuclear power sources have been successfully used in devices such as pace makers and remote monitoring equipment.

One area of much research has to do with the direct conversion of beta emissions, i.e. electrons, emitted from radioisotopes that are targeted on a semiconductor material to develop electron-hole pairs and thus generate an electrical current in the semiconductor. All of these devices suffer from very low efficiencies due to the poor electron capture cross section of the designs as well as the semiconductor material itself. This is the same phenomenon that solar cells continue to suffer from even after decades of work and hundreds of billions of dollars of investment.

Researchers have recently begun investigating nanotechnologies with which to implement nuclear power sources. Some of these include the development of micromechanical devices that vibrate or rotate in response to charge build up within the semiconducting materials.

The underlying reason for pursuing the development of nuclear batteries is the much wider goal of developing long lasting, low cost power sources. Along these lines, there are many other fields of research that are producing some interesting and potentially viable power sources. In particular, fuel cells and new electrochemical battery technologies look particularly promising for small, low cost, high density and long-lived power sources but none come close to the energy density and longevity that nuclear power sources offer.

Prior art describes four basic methods of converting radioisotopes into useable energy sources. Three of these require a double conversion process wherein the radioactive sources are used to first generate heat, light or mechanical energy which is then converted into electrical energy. These multiple conversion processes have extremely low efficiencies which puts them at a distinct disadvantage to compete with the fourth method which is referred to as direct conversion.

Of the direct conversion methods, the two that are the most studied are the semiconductor PN junction conversion and the capacitive charge storage conversion. The semiconductor conversion processes, also known as betavoltaics, employs semiconductor technology that suffers from device degradation and very low efficiencies. The capacitive charge storage devices have problems with large size and very high voltages that can reach hundreds of thousands of volts that create materials challenges that can withstand such high voltages. These problems are magnified as the devices are scaled down.

A common problem for all of the prior art is that the amount of energy that can be extracted from the radioactive material is a very low level and at a consistent output which doesn't provide a practical means to support real world applications that demand varying amounts of power at different times.

Of the most relevant descriptions of a nuclear batter disclosed in prior art, Baskis, U.S. Pat. No. 5,825,839, describes a direct conversion nuclear battery utilizing separate alpha and beta sources isolated by an insulating barrier and two charge collector plates, one to collect the negative beta particles and a another plate collect the alpha particles. The two plates become charged and thereby storing the energy in the form of an electric potential the same as a capacitor stores electrical energy in the form of positive and negative charges on parallel plates. This approach utilizes the balanced alpha/beta charge approach as the present invention, but for completely different purposes. In the Baskis disclosure, a load place across the "battery" allows electrons to flow from the negative charged plate to the positively charged plate that is saturated with alpha particles. The recombination of the electrons and the alpha particles is said to produce helium gas which is vented out of the cell. However, this description does not address the recombination of "free" electrons in the metal plate combining with the alpha particles producing He gas directly. However the net effect is the same, the positive plate will become increasingly positively charged by the alpha particles producing a stored electric potential across the device.

The preferred embodiment of the present invention also suggests the use of balanced alpha and beta charges for greater efficiencies, however, such a requirement is not necessary for it to operate. Additionally the present invention can store the energy of the alpha and or beta particles in chemical energy form as a chemical battery as well as in electric potential energy as in a capacitor, as described in alternative embodiments.

BRIEF SUMMARY OF THE INVENTION

The present invention incorporates aspects of three different energy generation and storage technologies, those being: Nuclear beta and/or alpha direct conversion, fuel cells, rechargeable electrochemical storage cells and capacitive energy storage. In the present invention, a radioisotope, or a mixture of radioisotopes, that emits beta and/or alpha particles is used as the primary energy source while an electrochemical cell is used as both a secondary energy source as well as an energy storage mechanism and a capacitor may be used as a primary storage device.

This disclosure illustrates the core concepts for the construction and manufacture of the device but by no means limits the actual materials to only those used as examples and discussed herein nor the embodiments described. For example, almost any radioisotope can be used as the primary fuel source for this invention but those that are, at this time, considered safer, more optimal or more readily accessible are more desirable, especially for devices that could be used for equipment that will be in close proximity to humans or animals. As research continues and future advanced occur, it may become feasible that other radioisotopes may be well suited for use in this device and the following discussions are by no means intended to limit the invention to only the specific materials used or discussed herein. This is true for the materials used including those for the electrochemical and capacitive storage materials as well.

Additionally, no limitations to the embodiments of the described invention are to be inferred. This disclosure is to be interpreted in its broadest sense as to any materials that can be used as well as to the physical embodiments in which the concepts can be applied. For instance, there are hundreds of radioactive materials that can emit alpha and or beta particles and electrochemical batteries and capacitors can be built in an unlimited number of shapes, sizes, storage capacity, energy densities or materials. There are also many rechargeable battery chemistries that can be used in said present invention and no limitations as to the type of rechargeable battery or chemistry that can be used to implement such a device is implied.

Any radioisotopes or combination of radioisotopes that emit alpha and or beta particles can be used for this device. However, because the device takes advantage of both the positive charges of the alpha particle and the negative charge of the beta particle, to generate dc current directly as well as to provide a charging mechanism for the electrochemical cell, radioisotopes that produce both particles are expected to produce greater energy density and efficiencies than isotopes that produce only alpha or beta particles, however any combinations of radio isotopes or individual radioisotopes can be used. Radioisotopes that produce low energy alpha and or beta particles are particularly useful in this application since the emissions can be contained within the structure itself, thus eliminating the health issues of ionizing gamma and or neutron radiation. Isotopes that produce gamma rays and high-energy neutron are less desirable due to their associated health risks, and the inability to completely contain these emissions within the power cell itself. However, the power cell can be adapted for their use for certain applications where these issues are not a concern, for instance in generating electrical energy from nuclear waste products stored in long term storage facilities. In this case, the hazardous material is already placed in secured facilities where the high-energy emissions cannot harm persons or the environment. Using any or all available radioisotopes to generate electrical energy would be a good use for this invention. Additionally, space probes could, from a human safety standpoint, use any radioisotope material.

While the invention has been described with reference to some preferred embodiments of the invention, it will be understood by those skilled in the art that various modifications may be made and equivalents may be substituted for elements thereof without departing from the broader aspects of the invention. The present examples and embodiments, therefore, are illustrative and should not be limited to such details.

DETAILED DESCRIPTION OF THE INVENTION

Figure 1:
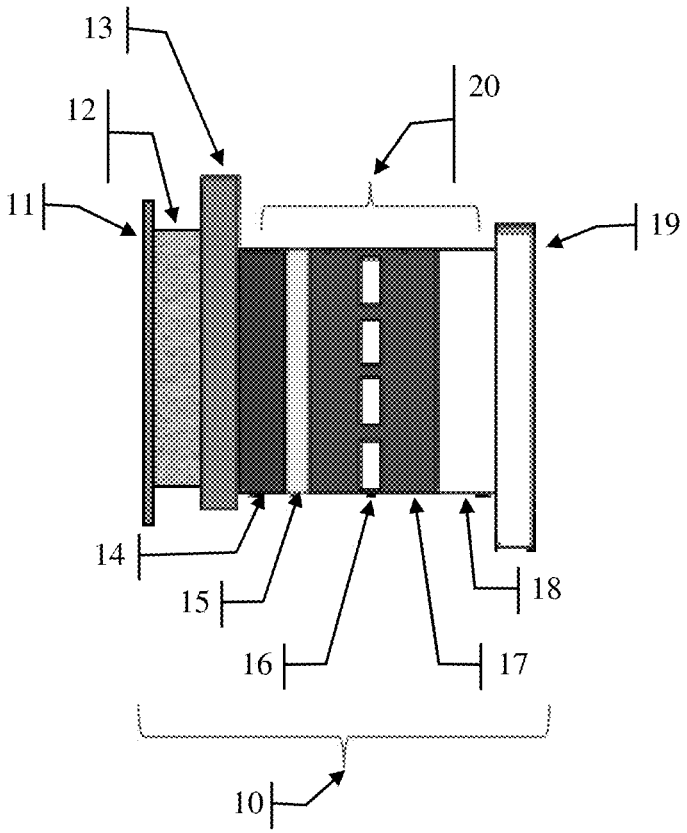
FIG. 1 illustrates a cross-section of a device according to a preferred embodiment of the invention.
Figure 2:
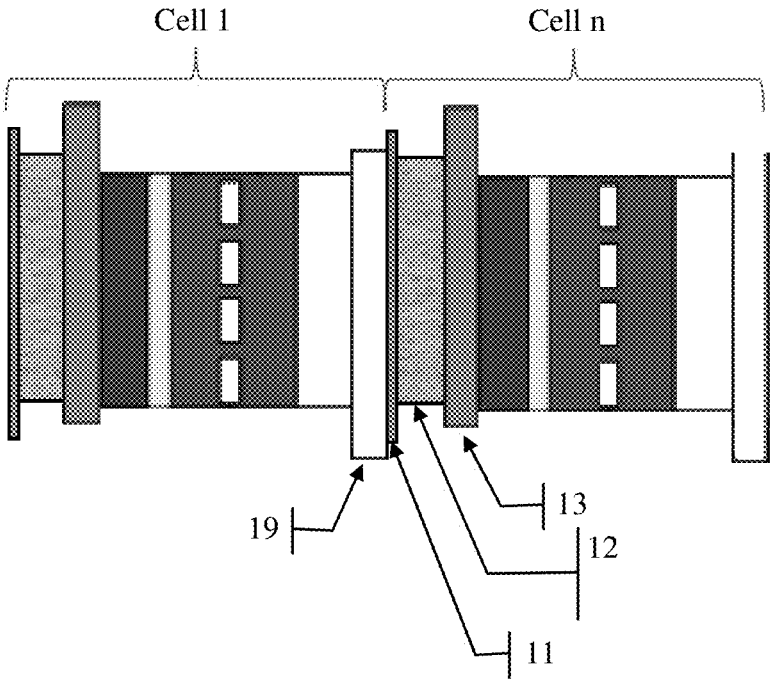
FIG. 2 illustrates a stacked cell configuration.

For the following discussion, refer to FIG. 1. The device 10, comprises a rechargeable electrochemical cell 20, such as a Lithium Ion cell, which may be comprised of a cathode plate 19 such as aluminum, a Li ion capture material 18 such as LiCoO2 (or LiMnO2, or others), an electrolyte material 17 such as a lithium salt dissolved in organic solvent with a semipermeable membrane 16 separating the anode and cathode sides of the cell, a carbon anode 14 with an plate 13 such as copper, a layer of radio isotope material or a mixture of radio isotope materials 12 which emit alpha and or beta particles, with a bonding (agent not shown) and a proton exchange membrane layer 11 that is comprised of a highly negatively charged material, and a dielectric insulating layer (not shown). These layers can be rolled up to produce a typical cylindrical battery device, referred to in the industry as a "jelly roll," and shown in FIG. 6, or stacked on top of each other in many layers to produce irregular shapes and sizes that would be used in consumer electronic devices as shown in FIG. 2. While the secondary battery technology described herein happens to be a Li-Ion type battery, any battery storage technology compatible with this invention can be used, and a person skilled in the art of battery chemistry and technologies could easily adapt any battery technology to be useful in this invention.

The amount of radioisotope material that would be needed in a particular power cell would depend upon the activity level of the particular material used and the amount of energy that the power cell would need to provide for a specific application.

Figure 6:
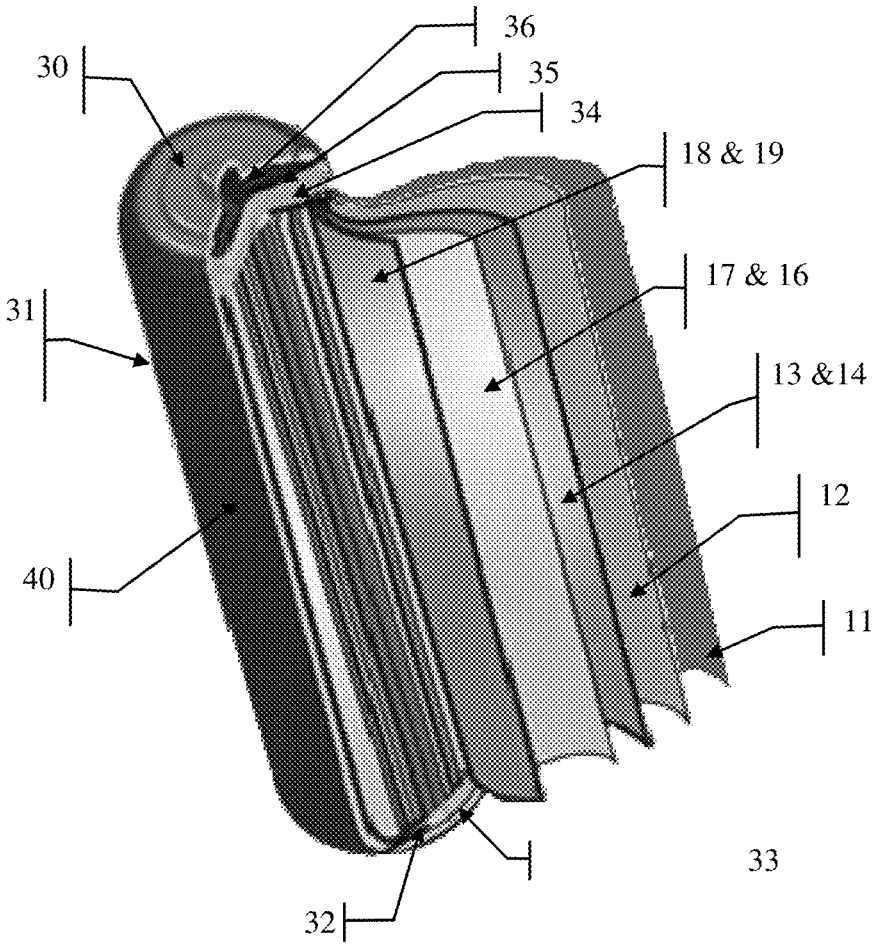
FIG. 6 illustrates an embodiment of an implementation in a form of a standard cylindrical battery that is commonly available.

FIG. 2 shows a cross section a stacked cell implementation of the invention as the cells would exist relative to each other. This orientation would exist whether individual cells are stacked on top of each other or a long single cell was rolled up into a cylindrical shape. In FIG. 6, the layers of the cell would be rolled up upon themselves to create a cylindrical form similar in size and shape of common commercially available batteries such as "AA", "AAA", "C" and "D." Of course any shape or size can be constructed by stacking the layers shown in FIG. 2. When stacking layers, the PEM (Proton Exchange Membrane) layer 11 would be located between the radioisotope material layer 12 and the cathode plate 19. Also note that the cathode plate 19 and the anode plate 13 are offset with respect to each other and with respect to the PEM layer 11 so as to prevent shorting the cells when they are assembled as well as to allow each cathode plates 19 to be connected together on one end or side of the cell and the anode plates 13 to be connected together on the other end or side of the cell. This also provides a means to connect the anode and cathode to the cell contacts for external connections.

Theory of Operation

Figure 3:
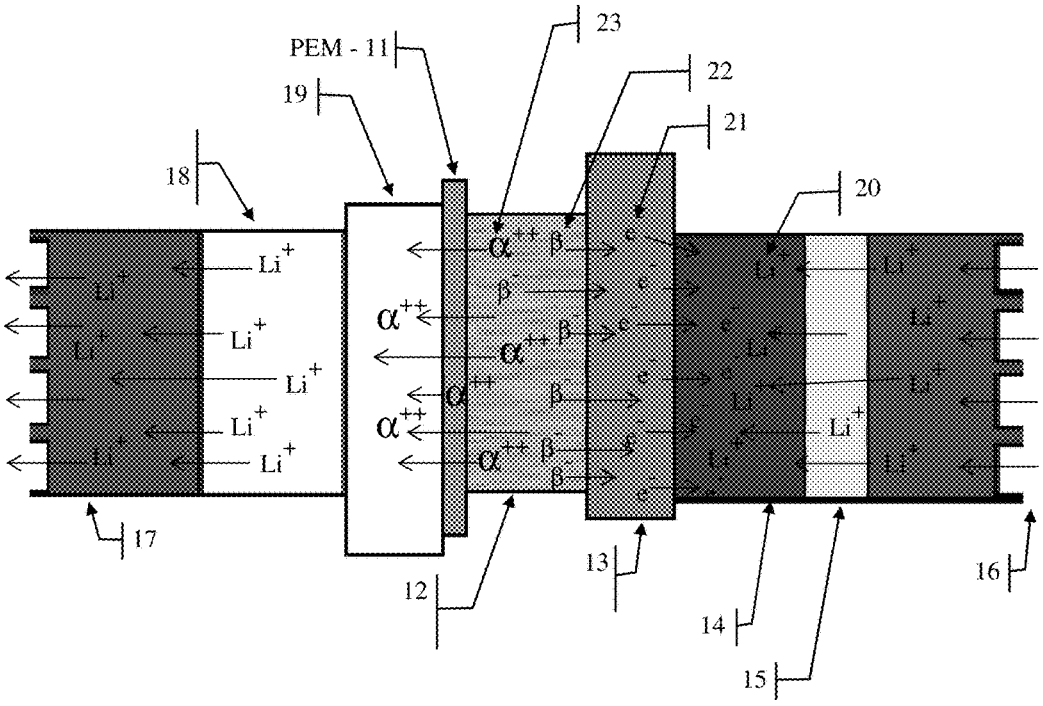
FIG. 3 illustrates an internal self-recharging process.

Refer to FIG. 3 for the following discussion. A key aspect to the invention is the adoption of a proton exchange membrane 11 (PEM) similar to that used in fuel cell technologies. A common type of material used for this application is Nafion. There are a number of proton exchange membranes available that can be used in the present invention. In fuel cells, the PEM is a highly electronegative porous material that allows the positive charged "protons" to cross the membrane boundary between the anode and cathode while repelling the disassociated electrons and forcing them to flow around the cell, through an external circuit. These PEM characteristics are exploited in the present invention to allow the doubly positively charged alpha particles 23, which are approximately the same size as methanol "protons" to pass through the PEM material 11 and collect in the cathode plate 19, while forcing the beta particles 22, i.e. electrons, to flow to the anode plate 13 and collect there. The positive charges carried by the alpha particles 23 and captured by the cathode plate 19 and the negative charges carried by the beta particles 22 and captured by the anode plate 13 will migrate to their respective cathode 18 and anode 14 regions causing the cell 10 to store the charges. These charges would then cause the lithium ions 20 to migrate from the cathode 18 through the electrolyte region 17, across the separator membrane 16, further across the solid electrolyte interphase (SEI) layer 17, which is formed upon first charging, and finally to in situate themselves, intercalate, within the carbon layers of the anode 14, thus completing the charging cycle for a pair of alpha 23 and two beta 22 particles.

Figure 5:
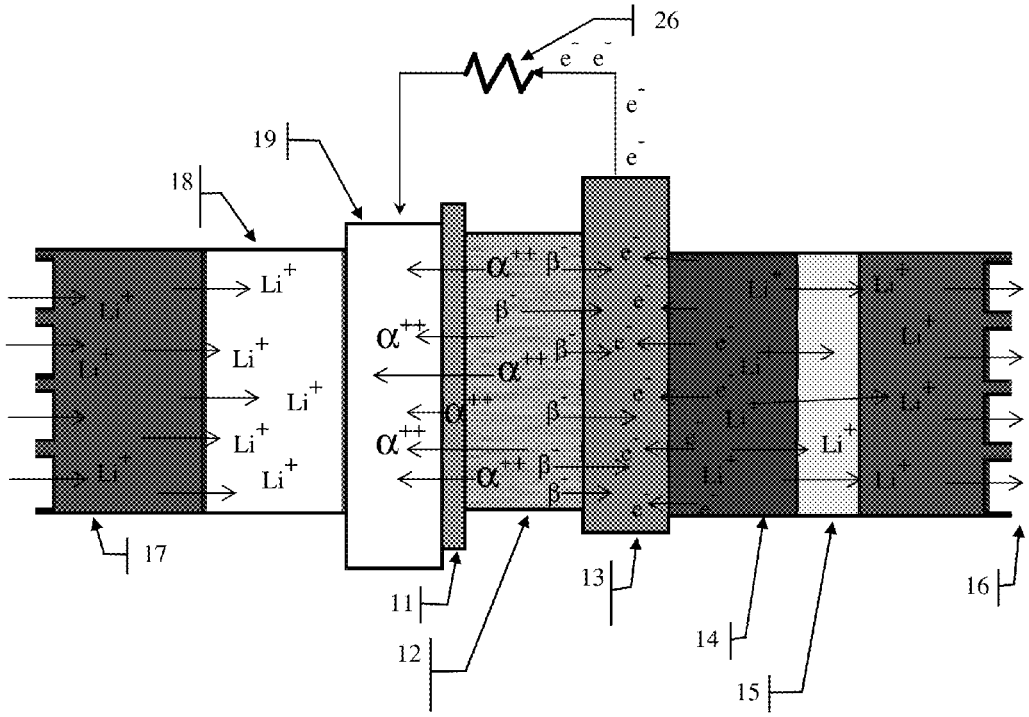
FIG. 5 illustrates a discharge process.

Referring to FIG. 5, when an electrical load is placed across the anode plate 13 and cathode plate 19, an electric circuit would be completed causing electrons from the anode 14 to migrate to the anode plate 13, through the external circuit 26 and returning to the cell at the cathode plate 19. The ideal cell would be achieved when amount of radio isotopic material 12 and the external electrical load 26 were balanced where the total electrical current emanating from the radioisotope region into the anode plate 19 and cathode plate 13 were to equal the amount used by the electrical load 26. This is an ideal condition that is unlikely to ever be achieved. Normally electrical loads have varying power requirements and this is where the rechargeable electrochemical storage portion 20 of the cell 10 plays it role. It will provide additional power to the load 26 when it is needed and it will store the excess energy coming from the radio isotope material 12 for later use.

If an electrical load were connected across the anode plate 13 and cathode plate 19, an electric circuit would be completed causing electrons from the anode 14 to migrate to the anode plate 13, through the external circuit 26 and returning to the cell at the cathode plate 19. The ideal cell would be achieved when amount of radio isotopic material 12 and the external electrical load 26 were balanced where the total electrical current emanating from the radioisotope region into the anode plate 19 and cathode plate 13 were to equal the amount used by the electrical load 26. This is an ideal condition that is unlikely to ever be achieved. Normally electrical loads have varying power requirements and this is where the rechargeable electrochemical storage portion 20 of the cell 10 plays it role. It will provide additional power to the load 26 when it is needed and it will store the excess energy coming from the radio isotope material 12 for later use.

Figure 4:
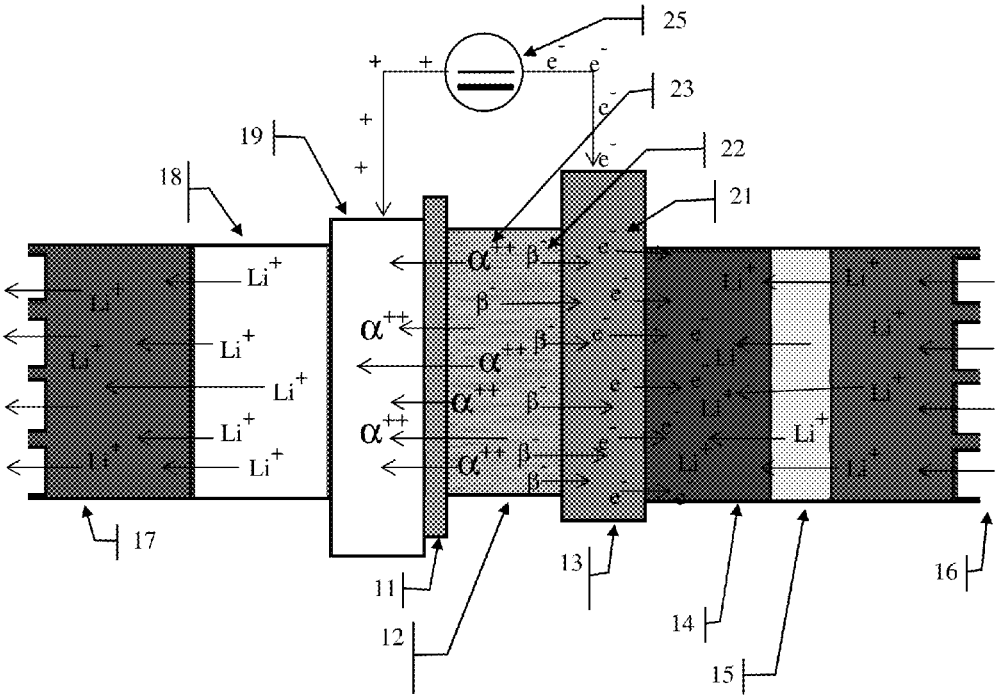
FIG. 4 illustrates an attachment and use of an external DC charge circuit.

Referring to FIG. 4, as with any secondary electrochemical cell, the present invention can be recharged by means of an external charging circuit 25 placed across the cathode plate 19 and anode plate 13. The charging circuit 25 injects electrons 21 into the anode plate 13 which migrate into the anode carbon layer 14 and speed up the lithium ion battery charging process as shown in FIG. 3.

During discharge, the beta particles 22 (electrons) emitted by the radio isotope layer 12 will flow directly through the anode plate 13 to power the external load 26 while the alpha particles will accumulate at the anode, completing the circuit. The current developed from the radioisotope material 12 will power the load reducing the draw from the stored energy of the secondary electrochemical battery cell 20. However, when the current drawn by the load 26 is less than the current developed by the radioisotope material 12, then the excess current will charge the secondary battery cell 20, thus acting as a charging circuit for the secondary electrochemical storage battery 20, the same as if the secondary battery were being charged from an external charging device 25.

Because of the affinity of the anode 14 to accept electrons and the highly electronegative characteristics of the proton exchange membrane (PEM) 11, the beta particles 22 are attracted to the anode plate 13 and collect there developing an overall negative charge on the plate which is transferred to the anode carbon layer 14. The increasingly negatively charged carbon anode 14 attracts positive lithium ions 20 from the electrolyte 17 causing the migration of the lithium ions 20 from the lithium metal oxide cathode 18. At the same time, the alpha particles 22 are attracted by the overall negatively charged proton exchange membrane (PEM) 11 and migrate towards it. The PEM 11 doesn't have any binding sites for the alpha particle and its physical properties allow the alpha particles 22 to pass through it to the cathode plate 19 where they are able to bind with the cathode plate 19 and transfer their positive charges to the cathode plate 19, thereby oxidizing the cathode layer 18 and liberating more lithium ions 20 to migrate across the cell to the anode 14.

Alternative Embodiments

Since the radioisotope material 12 continually emits alpha and/or beta particles 22 and 23, at some point the battery will become fully charged with all Lithium ions 20 being intercalated within the carbon material of the anode 14 but the radioisotope material 12 will still be developing an electrical potential. Some of this unused electrical potential can be stored in an integral super capacitor (not shown in drawings) surrounding the entire battery device but inside the enclosure 31.

The super capacitor is created by connecting one thin metal plate (not shown in drawings) to the anode plate 13, another thin metal plate (not shown in drawings) attached to the cathode plate 19 and a thin insulating material (not shown in drawings) separating said plates. However, depending upon the total energy storage capacity of the device and the system load demands, eventually one of two conditions will occur.

Either the cell will be completely depleted or it will become fully charged. In the event of a full charge within the electrochemical cell and any integral capacitor of the battery, the excess energy will have to be exhausted as heat. This excess energy is most effectively released through a resistive material (not shown in drawings) around the outer surface of the cell but inside the protective metal enclosure 31 or incorporated as an integral part of said enclosure 40, so as to radiate off excess energy as heat into the surrounding environment. A built-in charging and discharging control circuit can be used to control the excess energy bleed off.

A second situation exists where the device becomes completely discharged and cannot provide sufficient power for the intended load. At this point, the equipment which is powered by the device is turned off or the power cells are changed out for fresh cells. In either circumstance, the radioisotope will recharge the cell. Current lithium battery technologies limit discharge to about 40 percent. A deep discharge will damage the battery and limit its lifespan. This situation is prevented by a charge control circuit which will prevent battery damage due to overcharging or over discharge.

Alternatively, a standalone self-charging nuclear capacitor is made by applying a thin layer of the radio isotope to one side of a thin metal foil then a layer of the PEM material over the radio isotope combined with a binding material followed by the second metal foil layer and finally a dielectric membrane is placed on the top of the second foil layer. These layers are then rolled up so that the two metal layers are separated by the dielectric membrane. The metal foil layers are chosen just as in any electrolytic capacitor so that the plates have a propensity to attract and store positive or negative charges. An example would be aluminum and tantalum foils.

As described above, this capacitor can be implemented directly in the nuclear rechargeable electrochemical power cell by adding the capacitor layers sandwiched in the radioisotope layer. If the cell design characteristics are chosen to incorporate a high voltage capacitor to store more power, a voltage regulator would be needed to regulate the charge voltage for the electrochemical cell to protect it from damage from over charging and over voltage. A large amount of energy can be stored within this super capacitor that can be used for loads that demand very high currents for very short periods of time or if regulated can produce lower voltages for longer periods of time, or even other voltages than that of the battery.

Since alpha particles possess a positive double (+2) charge, they are easily deflected by electric or magnetic fields. The electric field generated by the cell construction, with or without the high voltage capacitor may be effective in driving the alpha particles towards the cathode collector plate and thus, increasing efficiency. Similarly, the addition of a magnetic material layer that creates a magnetic field that directs the alpha particles towards the cathode may also be effective in increasing efficiency. These same phenomena may also serve to push the electrons towards the cathode as well.

External Charging

The inherent nature of the self-recharging battery does not preclude the capability of a fast charging in an external charging device. A nuclear battery of this design can be quickly charged by means of inserting it into an external battery charger, similar to existing battery charging devices using standard charging techniques.

A self-monitoring circuit to indicate to the user the level of charge that the cell has at any given time can be incorporated into the device. Since the radioisotope would continuously charge the device, especially when it is not in use, power cells using this technology can be swapped out of equipment, set aside, and they will recharge automatically. Alternatively, they could be charged more quickly by an external charger device. The charge indicator would be powered by the device directly and would let the user know how much power is available at any given time.

An electronic circuit that could control the internal and external charging and discharging characteristics of the battery could be incorporated as a safety/security aspect of the device. This circuit could be used to control the total charge of the battery as well as to disable the battery recharge system to prevent automatic self-recharging or external recharging. This functionality would be useful in a battlefield situation where the battery may be lost or stolen. In such a situation, the battery could be rendered useless, or at least prevented from recharging. Such a system can be implemented by incorporating a built in electronic chip/circuit that would enable or disable recharging or it could force discharging of the battery under specific conditions through the resistive load material used to bleed off excess power. For instance, such a condition may be where a warfighter would carry a tiny wireless control device (perhaps built into some other equipment) that would communicate with the battery controlling its functionality. Should the battery become lost or stolen and unable to communicate with some approved remote control device, the battery could automatically render itself useless, either by discharging or not allowing itself to be recharged externally or internally, thus rendering it useless to anyone but those with the correct controller devices.

This same wireless control circuit could be used as a locator beacon that could be activated under any number of predefined conditions such as tampering or destruction of the cell in an attempt to obtain the nuclear materials.

While the invention has been described in detail and with reference to specific embodiments thereof, it will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A battery comprising:

a membrane material capable of collecting alpha particles;

a first plate;

a radioisotope material positioned between the membrane material and the first plate;

a second plate;

a rechargeable electro chemical cell positioned between the second plate and the first plate;

a housing accommodating the radioisotope material, the membrane, the first plate, the rechargeable electro chemical cell, and the second plate; and connection leads including a cell anode lead coupled to the second plate, and a cell cathode lead coupled to the first plate.

2. The battery of claim 1, wherein the radioisotope material, the membrane, the first plate, the rechargeable electro chemical cell and the second plate are rolled up producing a rolled assembly.

3. The battery of claim 1, wherein the connection leads connect an anode plate and a cathode plate to the housing for connections to at least one external power load.

4. The battery of claim 2, further comprising a capacitor assembly which comprises, a first dielectric material layer proximate to an outer layer of the rolled assembly;

a third plate proximate to the first dielectric material layer;

a second dielectric layer proximate to the third plate;

a fourth plate proximate to the second dielectric layer; and connection leads connecting the third plate to the cell anode lead and connecting the fourth plate to the cell cathode lead;

an insulating material layer enclosing the cell and the capacitor assembly;

a housing enclosing the rolled assembly; and leads connecting the anode plate and the cathode plate to the housing.

5. The battery of claim 1, wherein the radioisotope material, the membrane, the first plate, the rechargeable electro chemical cell and the second plate are connected in parallel to each other.

6. The battery of claim 1, wherein the battery can be charged by means of an external charge circuit.

7. The battery of claim 1, wherein the rechargeable electro chemical cell is comprised of:

an anode layer;

a cathode layer;

an electrolytic layer separating the anode layer and the cathode layer; and a separating membrane positioned within the electrolytic layer.

8. The battery of claim 1, wherein the radioisotope material comprises one of a radioisotope alpha emitter material, a radioisotope beta emitter material or a mixture of radioisotope materials that emit alpha and beta particles.

9. The battery of claim 1, wherein the membrane material is configured to pass alpha or positive particles and reject beta or negative particles, or to pass beta or negative particles and reject alpha or positive particles.

10. The battery of claim 1, wherein the first plate collects alpha particles or positive charges.

11. The battery of claim 1, further comprising a control and monitoring circuit capable of rendering the battery inoperable.

12. The battery of claim 1, wherein the second plate is capable of capturing beta particles.

13. A battery comprising:

a membrane material configured to pass alpha particles and reject beta particles;

a first plate;

a radioisotope material capable of emitting the alpha particles and the beta particles, being positioned between the membrane material and the first plate;

a second plate;

a rechargeable electro chemical cell including an anode layer, a cathode layer, an electrolytic layer separating the anode layer and the cathode layer, and a separating membrane located within the electrolytic layer, the rechargeable electro chemical cell being positioned between the second plate and the first plate;

a housing accommodating the radioisotope material, the membrane, the first plate, the rechargeable electro chemical cell, and the second plate; and connection leads to the anode layer and cathode layer with an electric potential between for powering at least one external load.

14. A battery of claim 13, further comprising a charge control and monitoring circuit to monitor cell voltage, temperature and charge level; and an overcharge control circuit to bleed of excess power.

15. A battery having one compartment, comprising:

a membrane material capable of collecting alpha particles;

a radioisotope material positioned next to the membrane material;

a rechargeable electro chemical battery positioned by the radioisotope material; and a housing enclosing the membrane material, the radioisotope material, and the rechargeable electro chemical battery, wherein the membrane material, the radioisotope material and the rechargeable electro chemical battery are housed within the one compartment of the battery.

16. A battery of claim 1, further comprising a control and monitoring circuit capable of sending a locator beacon signal for tracking purposes.

17. A battery of claim 1, further comprising a control and monitoring circuit capable of sending a signal indicating various parameters of its operation, condition and health.

* * * * *